US010276074B2

(12) United States Patent
Zhang

(10) Patent No.: US 10,276,074 B2
(45) Date of Patent: Apr. 30, 2019

(54) MODULAR AND FREELY COMBINABLE TENSION FABRIC POPUP DISPLAY

(71) Applicant: Hangzhou Bannermate Exhibition System Co., Ltd., Hangzhou (CN)

(72) Inventor: Hankai Zhang, Hangzhou (CN)

(73) Assignee: Hangzhou Bannermate Exhibition System Co., Ltd., Hangzhou (CN)

( * ) Notice: Subject to any disclaimer, the term of this patent is extended or adjusted under 35 U.S.C. 154(b) by 0 days.

(21) Appl. No.: 15/608,993

(22) Filed: May 30, 2017

(65) Prior Publication Data

US 2018/0053453 A1 Feb. 22, 2018

Related U.S. Application Data

(63) Continuation of application No. 15/238,731, filed on Aug. 17, 2016, now Pat. No. 9,697,755.

(51) Int. Cl.
*G09F 15/00* (2006.01)
*G09F 17/00* (2006.01)

(52) U.S. Cl.
CPC ..... *G09F 15/0062* (2013.01); *G09F 15/0012* (2013.01); *G09F 15/0018* (2013.01); *G09F 15/0025* (2013.01); *G09F 15/0068* (2013.01); *G09F 17/00* (2013.01); *G09F 2015/0093* (2013.01)

(58) Field of Classification Search
CPC ..... G09F 15/0068
USPC ..... 248/220.21, 220.22, 220.41, 220.42, 248/220.43, 223.41; 40/603; 38/102.91, 38/102.1, 102.4, 102.9
See application file for complete search history.

(56) References Cited

U.S. PATENT DOCUMENTS 4,658,560 A * 4/1987 Beaulieu ..... E04B 1/19 211/182
4,986,016 A * 1/1991 Wichman ..... E04B 1/3441 40/610
5,125,205 A * 6/1992 Wichman ..... A47F 5/13 40/610
5,203,134 A 4/1993 Sorenson et al.
6,054,968 A 4/2000 De Matteo
6,981,350 B1 * 1/2006 Redmon ..... G09F 15/0062 359/443

(Continued)

FOREIGN PATENT DOCUMENTS

CN 204580668 U 8/2015
WO WO 9949442 A1 9/1999

*Primary Examiner* — Joanne Silbermann
(74) *Attorney, Agent, or Firm* — Gokalp Bayramoglu

(57) ABSTRACT

The invention discloses a popup display, including at least one freely combinable tension fabric popup display, wherein the tension fabric popup display includes an exhibit grid frame, and aluminum grooved straight rods. The eight sides on the two planes of the exhibit grid frame are connected to the aluminum grooved straight rods. A popup display with a preset size and shape is provided by combining a plurality of tension fabric popup displays as needed. The aluminum grooved straight rods for the adjacent tension fabric popup displays are locked by a plurality of fasteners. The display before or after the combination is formed by inserting the silicon strips at the edges of the display into the grooves of grooved straight rods. The tension fabric popup displays of the invention can be combined freely to form various shapes, which are seamlessly attached by the fasteners.

15 Claims, 17 Drawing Sheets

(56) References Cited

U.S. PATENT DOCUMENTS

| | | | | |
|---|---|---|---|---|
| 8,616,510 | B2 * | 12/2013 | Zarelius | G09F 15/0062 160/135 |
| 9,214,104 | B1 * | 12/2015 | Matthews | G09F 15/02 |
| 9,697,755 | B1 * | 7/2017 | Zhang | G09F 15/0012 |
| 2006/0042141 | A1 * | 3/2006 | Hansen | E04B 2/7422 40/782 |
| 2009/0129885 | A1 * | 5/2009 | Csik | F16B 37/046 411/103 |
| 2012/0206661 | A1 | 8/2012 | Risher | |

* cited by examiner

MODULAR AND FREELY COMBINABLE TENSION FABRIC POPUP DISPLAY

CROSS REFERENCE TO RELATED PATENT APPLICATION

This application is a continuation application of U.S. application Ser. No. 15/238,731, filed on Aug. 17, 2016, which claims the priority of the Chinese patent application No. CN201610255967.3, filed on Apr. 21, 2016. The contents of the above applications are incorporated by reference in their entirety.

TECHNICAL FIELD

The invention relates to display equipment field, and particularly relates to a freely combinable tension fabric popup display.

BACKGROUND

With the rapid developments of the economy, various commercial advertising campaigns increase day by day. As an important aid for promoting corporate images, advertising exhibition display equipment is increasingly applied in various commercial fields such as shopping mall promotions, product promotions, exhibitions, press conferences and outdoor propagandas. There is various advertising exhibition display equipment, wherein a tension fabric popup display is a first choice for promoting products and using as a background due to simple assembly and portability. However, the current popup display cannot be combined freely, rendering the use limited.

SUMMARY OF THE INVENTION

The design objectives of this invention are to avoid the deficiencies of the prior arts and provide a freely combinable popup display.

The invention provides the following technical solution:

A popup display, includes at least one freely combinable tension fabric popup display, wherein the tension fabric popup display includes an exhibit grid frame, and aluminum grooved straight rods. The eight sides on the two planes of the exhibit grid frame are connected to the aluminum grooved straight rods. A popup display with a preset size and shape is provided by combining a plurality of tension fabric popup displays as needed. The aluminum grooved straight rods for the adjacent tension fabric popup displays are locked by a plurality of fasteners. The display before or after the combination is formed by inserting the silicon strips at the edges of the display into the grooves of grooved straight rods.

Further, the exhibit grid frame is composed of a plurality of X-shaped pull rods. The pull rods are connected to each other by plastic parts with nails. Link parts are located inside the exhibit grid frame. The link parts are fixed to two symmetrically arranged plastic parts with nails when the exhibit grid frame is open. Corner grooved plastic parts are fixed to the plastic parts with nails at the four corners of the exhibit grid frame. The eight sides on the two planes of the exhibit grid frame are connected to the aluminum grooved straight rods by the corner grooved plastic parts at both ends of the aluminum grooved straight rods.

Further, the plurality of tension fabric popup displays is horizontally or/and vertically combined to form the popup display with a preset size and shape.

Further, the fasteners have horizontal fasteners and vertical fasteners, including a base plate, a mobile plate, a cover plate and a rotation shaft. A first clamp plate with a bend is located at an end of the base plate. The rotation shaft penetrates through the base plate, and a rotation shifting block is disposed on the rotation shaft below the base plate. An eccentric cylinder is positioned at a top end of the rotation shaft above the base plate. A second clamp plate with a bend is disposed at an end of the mobile plate, and a circular aperture engaged with the eccentric cylinder is positioned in the mobile plate. The mobile plate is set around the eccentric cylinder via the circular aperture. The first clamp plate and the second clamp plate have a same orientation while the bend of the first clamp plate is opposite to the bend of the second clamp plate. The cover plate is positioned above the mobile plate to prevent the mobile plate from being removed from the eccentric cylinder. The first clamp plate and the second clamp plate are locked and released by rotating the rotation shifting block to drive the mobile plate to move. For the horizontal fastener, the bend of the first clamp plate and the bend of the second clamp plate are at the same level, while for the vertical fastener, the bend of the first clamp plate is higher than the bend of the second clamp plate.

Further, a semicircular groove is disposed in the base plate centered at the rotation shaft. A limiting pole is positioned within the semicircular groove by the rotation shifting block, ensuring the rotation shifting block rotating within a semicircle.

Further, the cover plate is fixed to the base plate by bolts, to prevent the mobile plate from being removed from the eccentric cylinder.

Further, either the whole fastener is made of metal, or the first clamp plate, the mobile plate and the second clamp plate are made of metal while the other parts are made of plastic. When the whole fastener is made of metal, the base plate and the first clamp plate are integrated and the mobile plate and the second clamp plate are integrated. When the first clamp plate, the mobile plate and the second clamp plate are made of metal while the other parts are made of plastic, the first clamp plate is fixed to the base plate by bolts, and the mobile plate and the second clamp plate are integrated.

Further, a plurality of supports is provided at the bottom of a tension fabric popup display, located in the lower part of a combination of tension fabric popup displays.

The advantageous effects of the invention are illustrated as below:

1. The eight sides on the two planes of the tension fabric popup displays in the invention are all connected to the aluminum grooved straight rods. The tension fabric popup displays may be combined freely, so as to form various shapes by connecting to each other horizontally or/and vertically, which is a complete subversion of the tension fabric popup displays of prior arts in application modes, sales modes and the customer experiences. In addition, for a large combined display and various booth solutions, the modular tension fabric popup displays may be arbitrarily connected to each other horizontally and vertically and the resulting products are very simple, and thus the tension fabric popup displays can be used widely.

2. When the tension fabric popup displays of the invention are combined, the aluminum grooved straight rods of the adjacent tension fabric popup displays are locked by a plurality of fasteners. The horizontal fasteners and the vertical fasteners are adopted according to the connections. The first clamp plate and the second clamp plate are locked and released by rotating the rotation shifting block to drive the mobile plate to move. The fasteners can be locked on the aluminum grooved straight rods at any position, ensuring seamless attachments in any shape and simple operations. Either the whole fastener may be made of metal, or the first clamp plate, the mobile plate and the second clamp plate may be made of metal while the other parts may be made of plastic, which results in a lighter weight and a lower cost while the objectives of the invention are achieved.

3. For assembly in the invention, the exhibit grid frame is quickly opened first to make the aluminum grooved straight rods quickly installed on the eight sides on the two planes of the exhibit grid frame. The tension fabric popup displays are combined according to a preset size and shape, and then locked with the fasteners. The tension fabric popup displays can be installed quickly without any tool or professional installer, to implement medium and large-sized booth solutions with a small installation size, a light weight, and easy portability and transportation. The display can be arranged with each plane of the combination of tension fabric popup displays, according to the preset solution. The display before or after the combination is formed by inserting the silicone strips at the edges of the display into the grooves of the grooved straight rods, ensuring no folds at the edges of the display to obtain the frameless effect.

To sum up, the tension fabric popup displays in the invention can be combined freely to form various shapes, which are seamlessly attached by the fasteners. There are no folds at the edges of the display due to grooved straight rods that create the frameless effect, and thus sufficiently ensuring the integrity of the display from a combination of tension fabric popup displays.

DETAILED DESCRIPTION

The invention is further explained combined with embodiments and the accompanying drawings. The following embodiments are only intended for illustrative purpose, without limiting the implementing scope of the invention.

Figure 1:
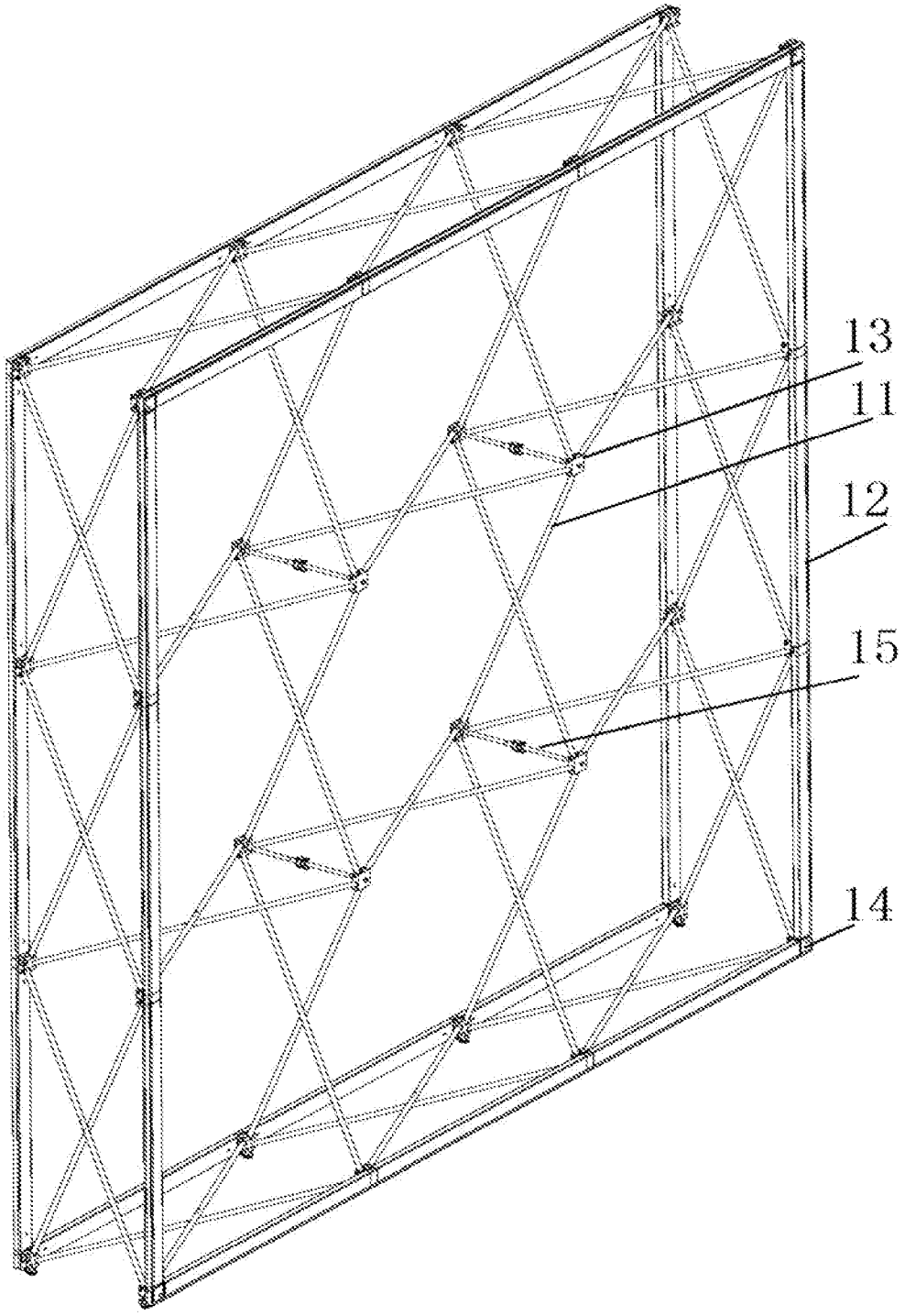
FIG. 1 is a structural schematic view of a single tension fabric popup display.
Figure 2:
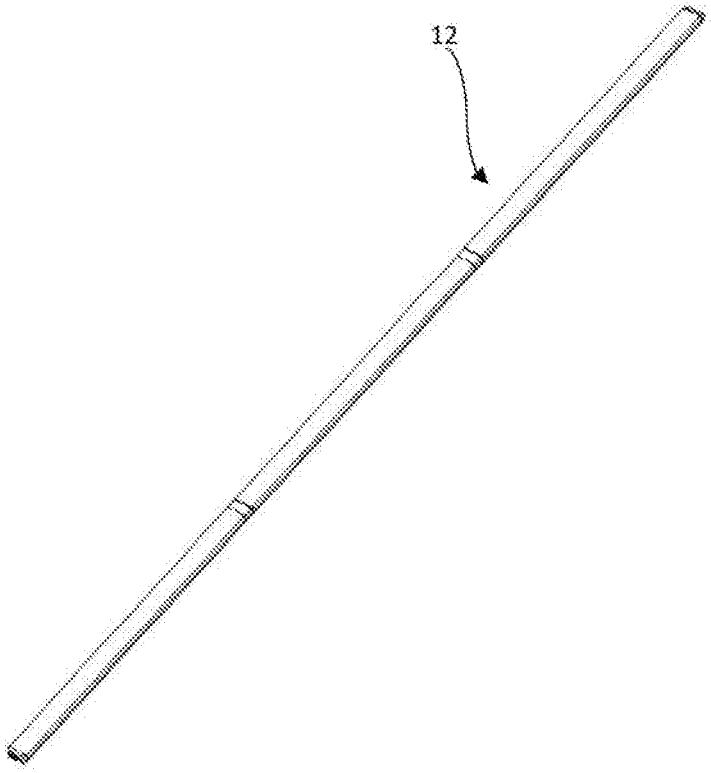
FIG. 2 is a structural schematic view of an aluminum grooved straight rod.
Figure 3:
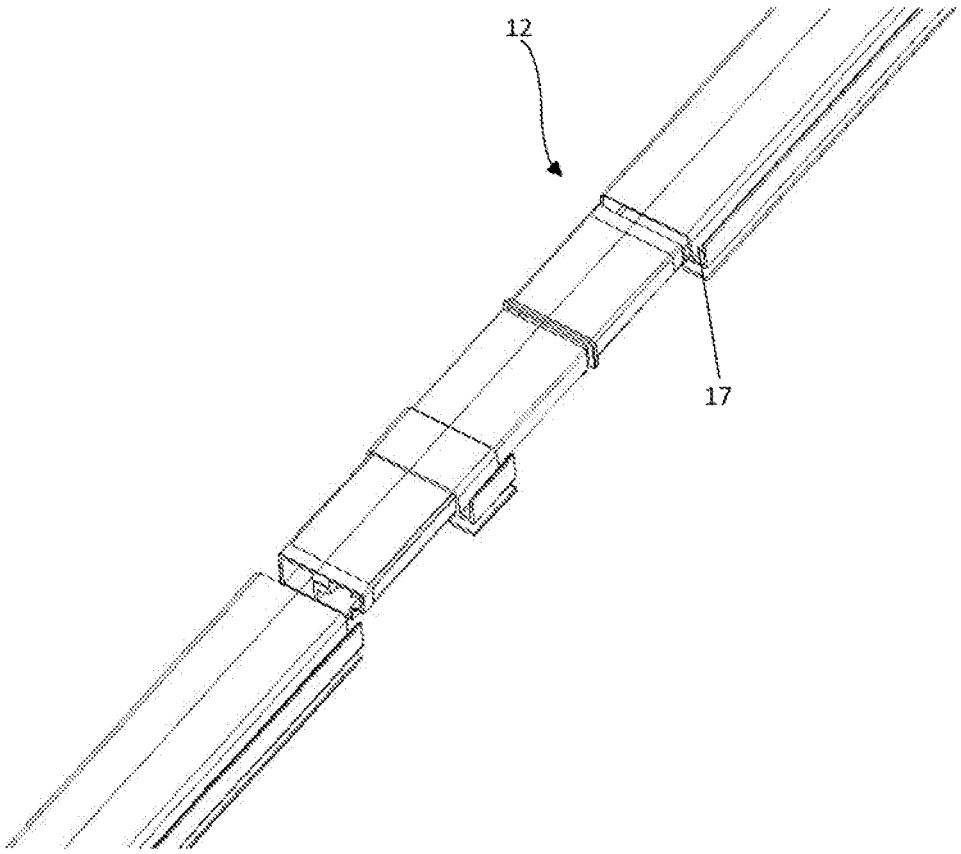
FIG. 3 is an explosive schematic view of the aluminum grooved straight rod.
Figure 4:
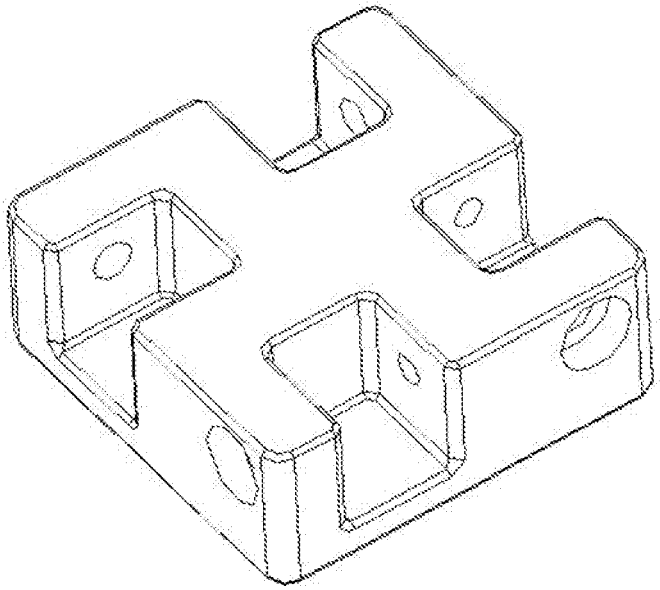
FIG. 4 is a structural schematic view of a plastic part with a nail of the grid frame.
Figure 5:
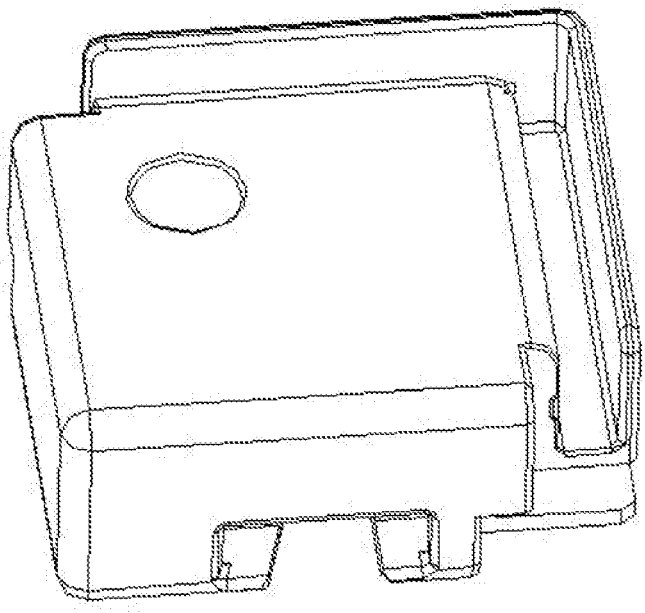
FIG. 5 is a structural schematic view of a corner grooved plastic part of the grid frame.
Figure 6:
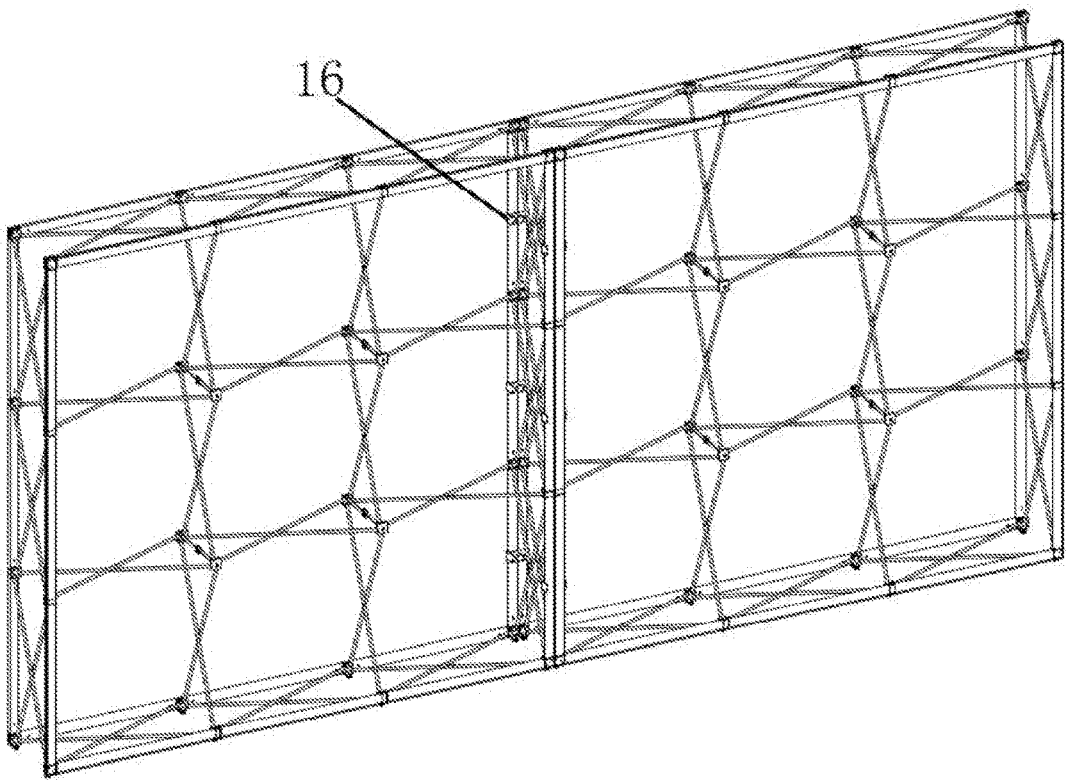
FIG. 6 is a structural schematic view of a first combination of tension fabric popup displays.
Figure 7:
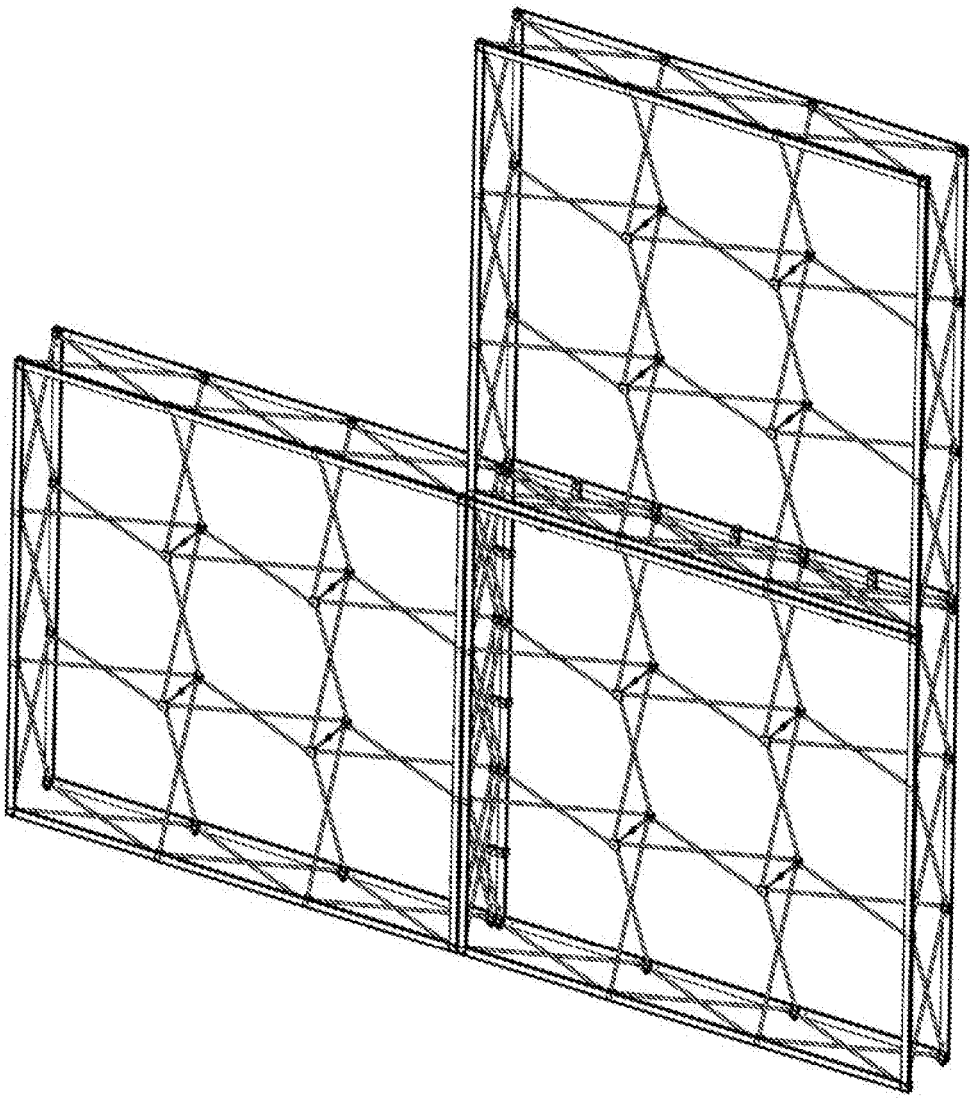
FIG. 7 is a structural schematic view of a second combination of tension fabric popup displays.
Figure 8:
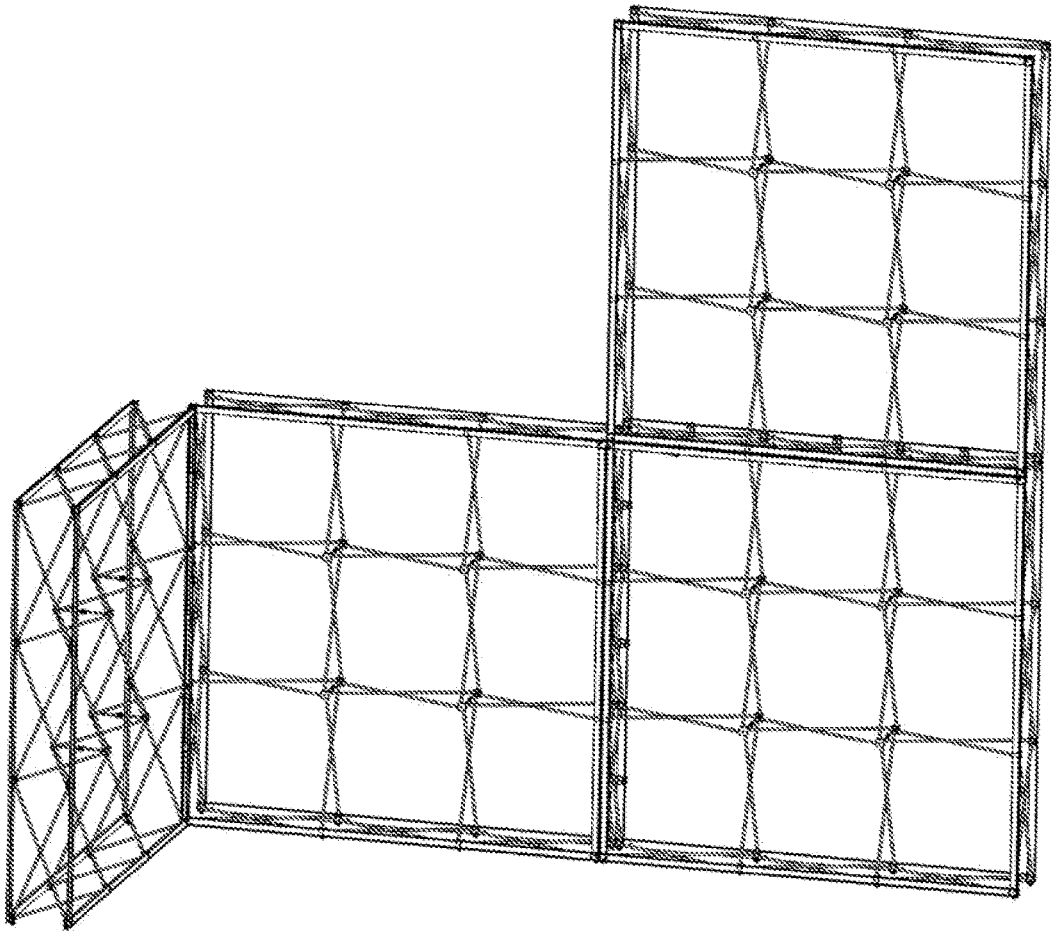
FIG. 8 is a structural schematic view of a third combination of tension fabric popup displays.
Figure 9:
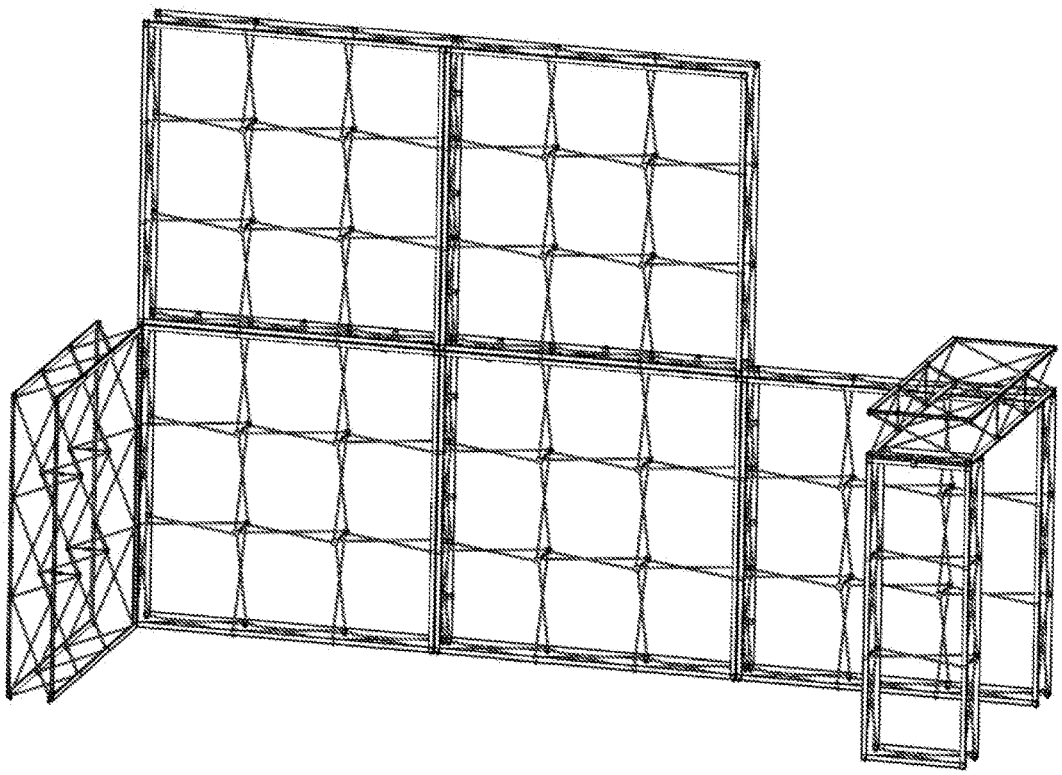
FIG. 9 is a structural schematic view of a fourth combination of tension fabric popup displays.
Figure 10:
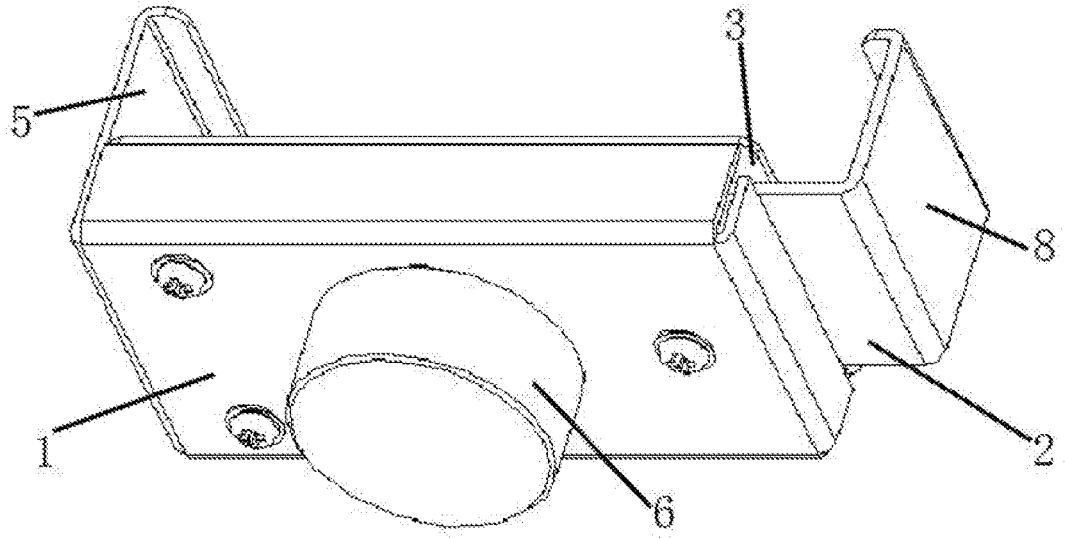
FIG. 10 is a structural schematic view of a horizontal fastener.
Figure 11:
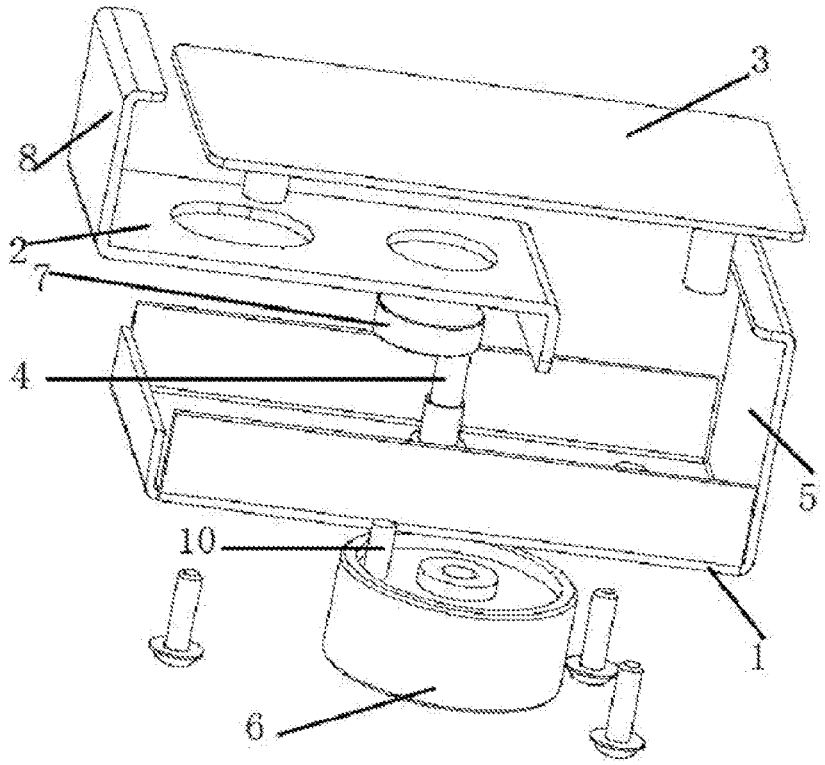
FIG. 11 is an explosive top view of the horizontal fastener.
Figure 12:
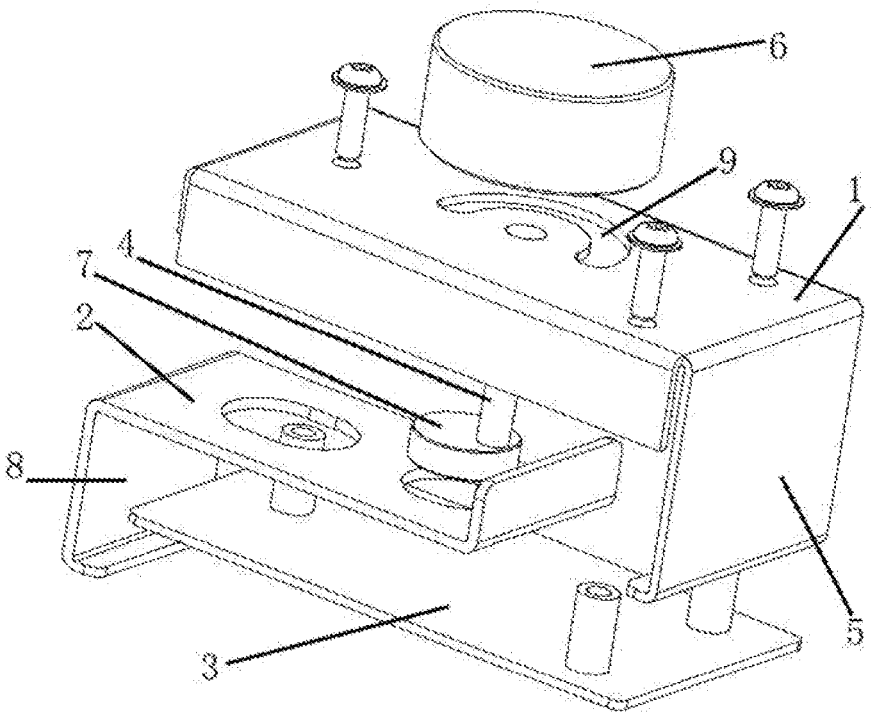
FIG. 12 is an explosive bottom view of the horizontal fastener.
Figure 13:
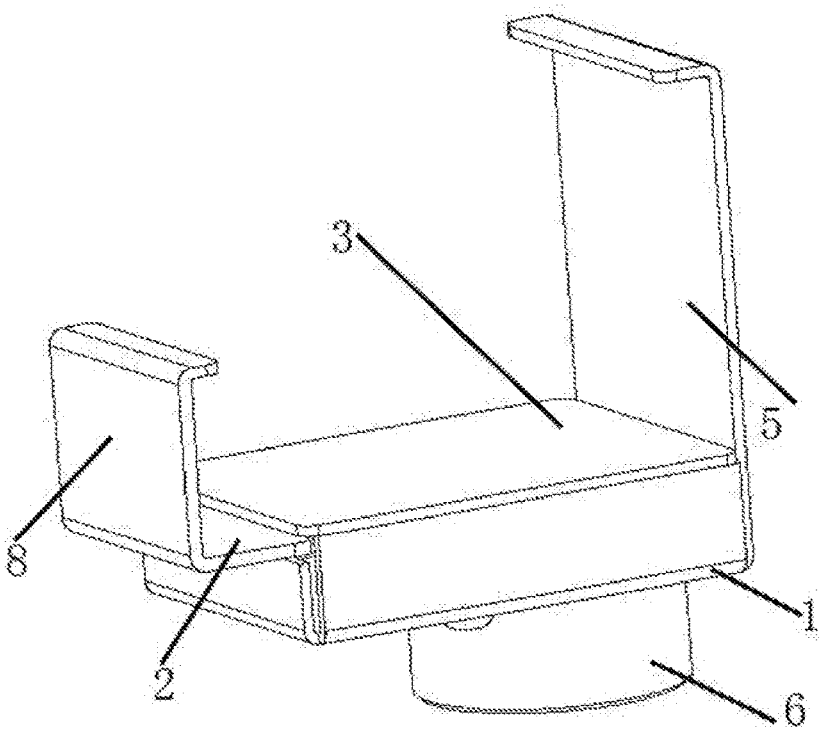
FIG. 13 is a structural schematic view of a vertical fastener (the base plate and the first clamp plate are integrated).
Figure 14:
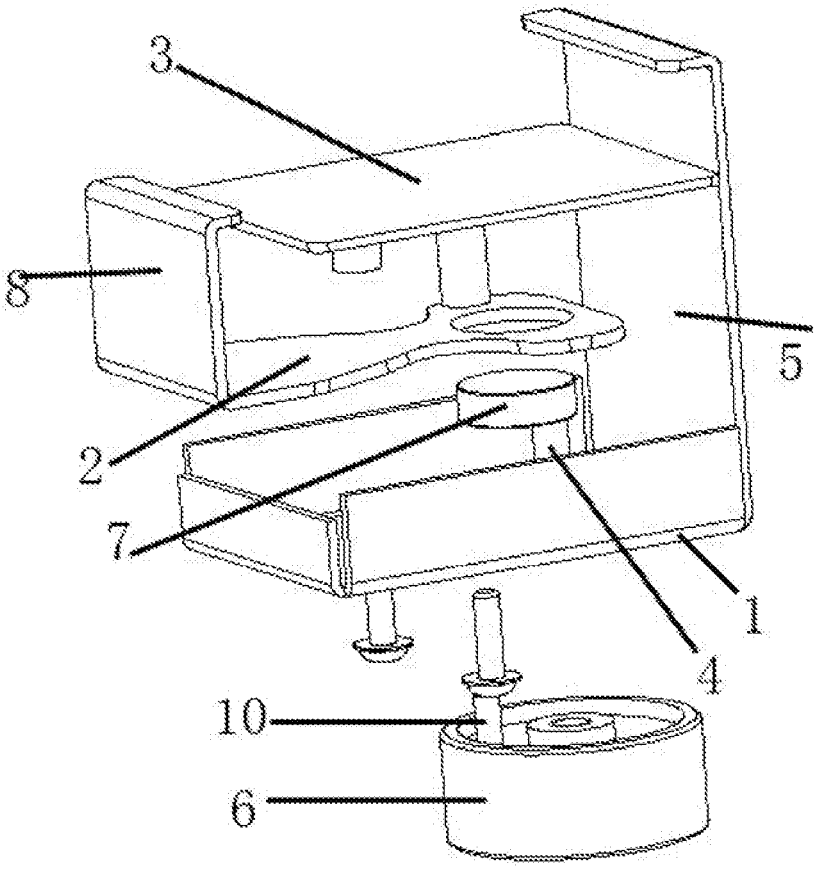
FIG. 14 is an explosive bottom view of the vertical fastener.
Figure 15:
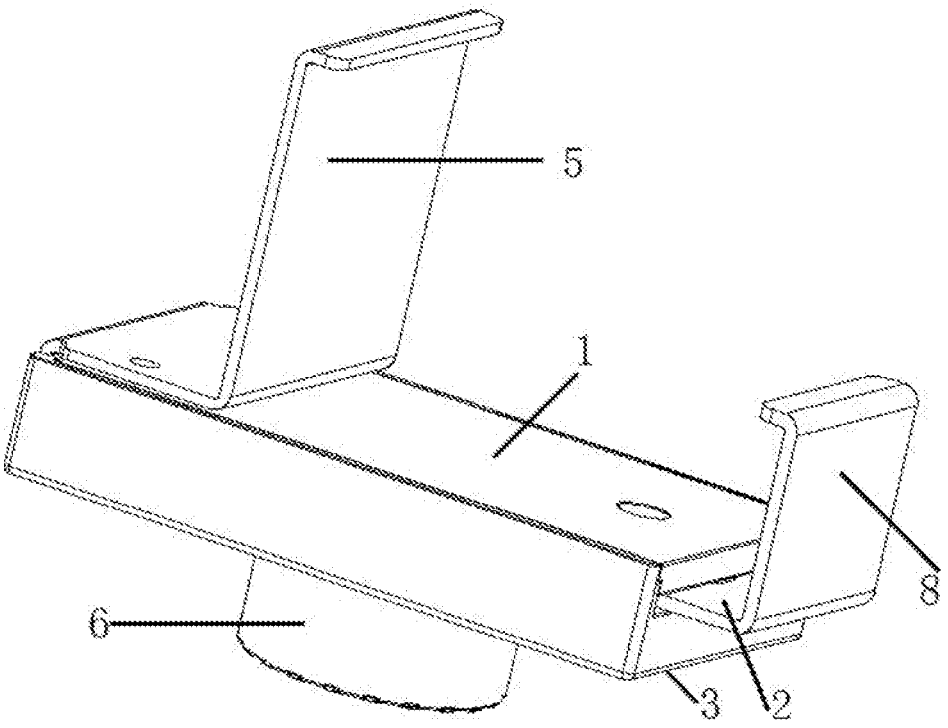
FIG. 15 is another structural schematic view of a vertical fastener (the first clamp plate is fixed to the base plate by bolts).
Figure 21:
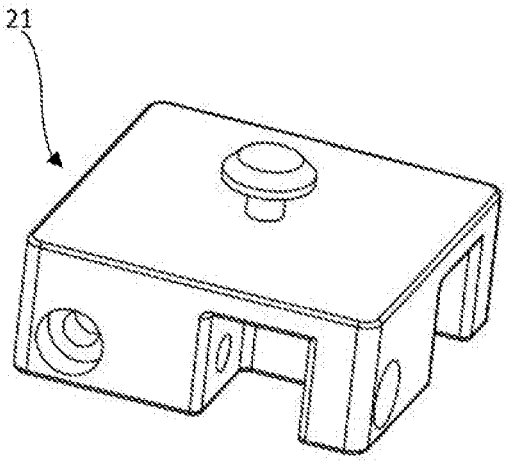
FIG. 21 is a structural schematic view of the nail.

A free combinable tension fabric popup display as shown in FIG. 1, includes exhibit grid frame 11, and aluminum grooved straight rods 12. Exhibit grid frame 11 is composed of a plurality of X-shaped pull rods. The pull rods are connected to each other by plastic parts 13 with nails 21. Link parts 15 are located inside the exhibit grid frame 11. Link parts 15 are fixed to two symmetrically arranged plastic parts 13 with nails 21 when exhibit grid frame 11 is open. Corner grooved plastic parts 14 are fixed to plastic parts 13 with nails 21 at the four corners of exhibit grid frame 11. The eight sides on the two planes of exhibit grid frame 11 are all connected to aluminum grooved straight rods 12 by corner grooved plastic parts 14 at both ends of aluminum grooved straight rods 12. As shown in FIGS. 2 and 3, aluminum grooved straight rod 12 includes a groove 17. Aluminum grooved straight rod 12 is divided into several sections with any length. Each section is fixed with each other by inserting plastic parts, forming a straight rod with a suitable length quickly and easily. Each section is connected to each other in series by ox tendon, rendering an easy installation and use. The structures of plastic parts 13 with nails 21 and corner grooved plastic parts 14 are respectively shown in FIGS. 4 and 5. Referring to FIG. 21, the structure of nail 21 is provided.

Figure 16:
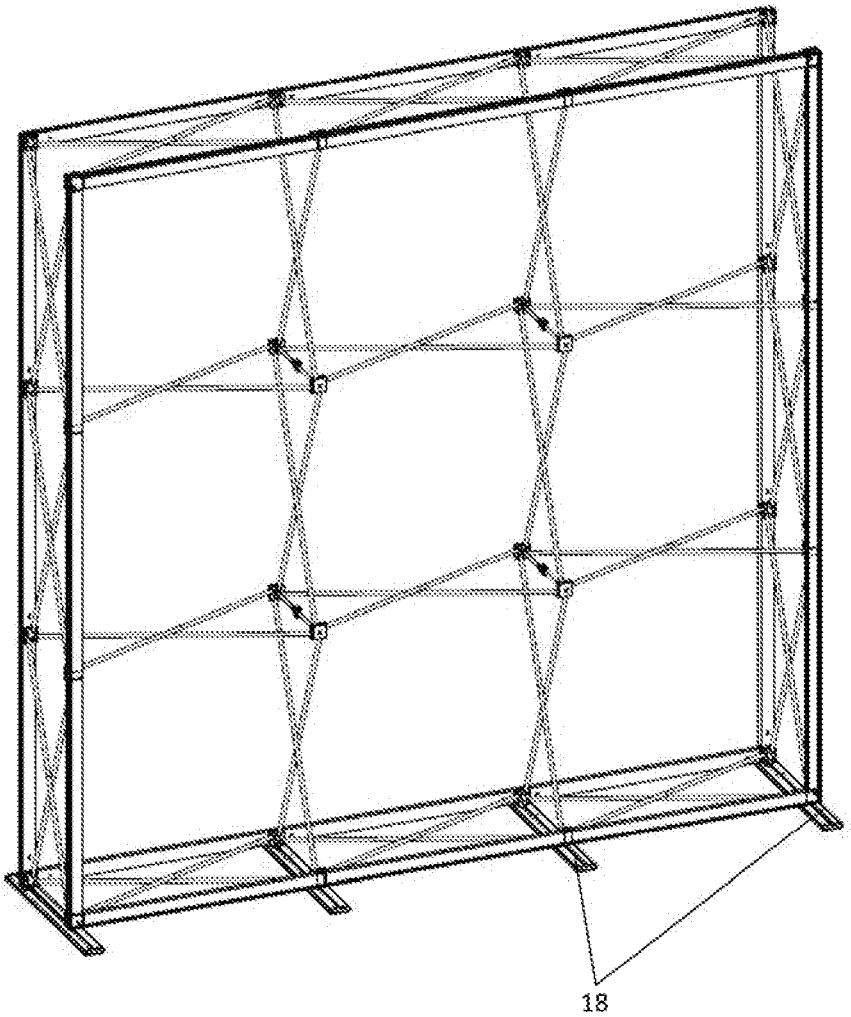
FIG. 16 is a structural schematic view of a single tension fabric popup display with supports.
Figure 17:
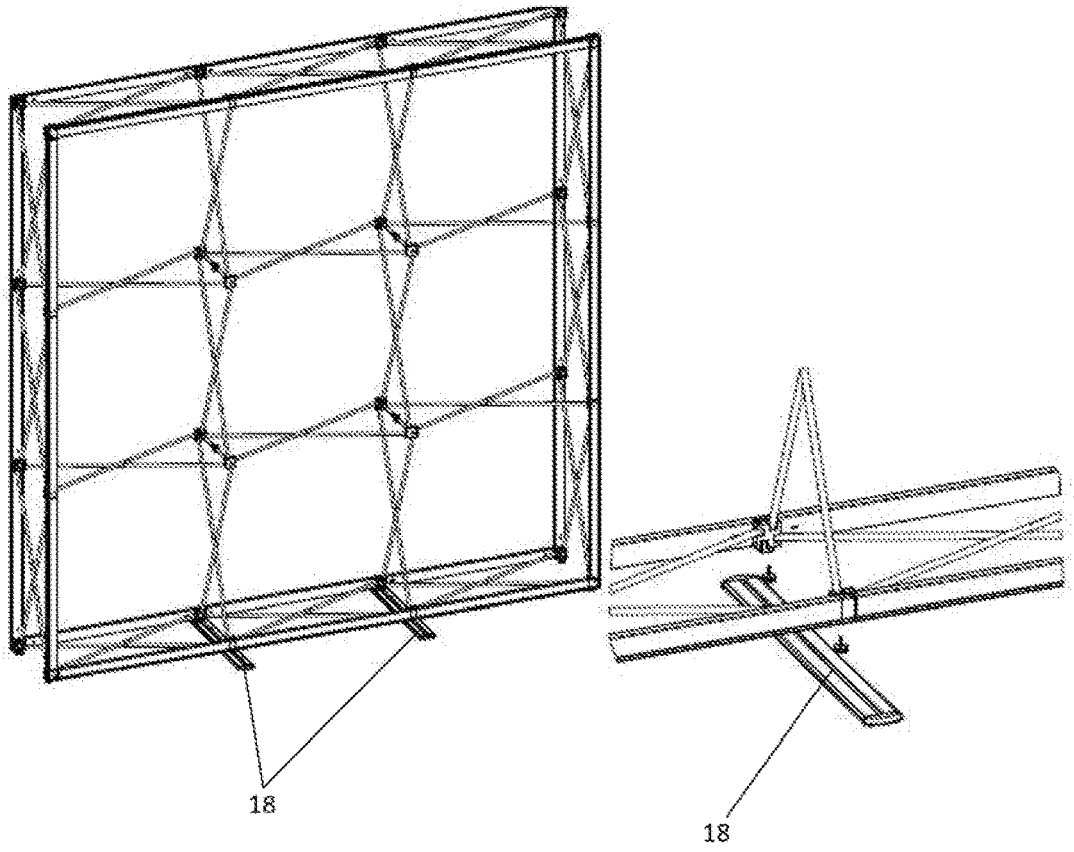
FIG. 17 is a structural schematic view of a single tension fabric popup display with supports in an enlarged view.
Figure 18:
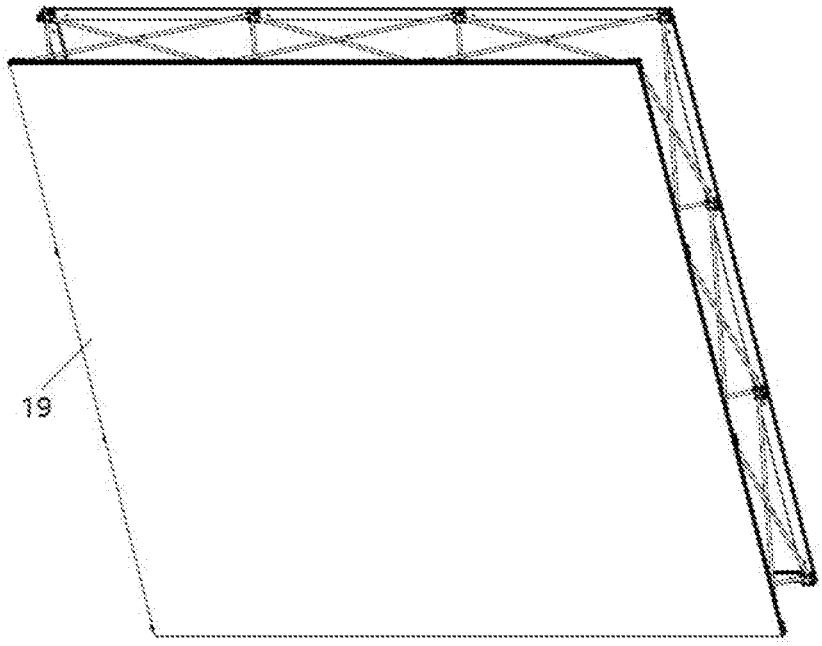
FIG. 18 is a structural schematic view of a single tension fabric popup display with an attached blank display.
Figure 19:
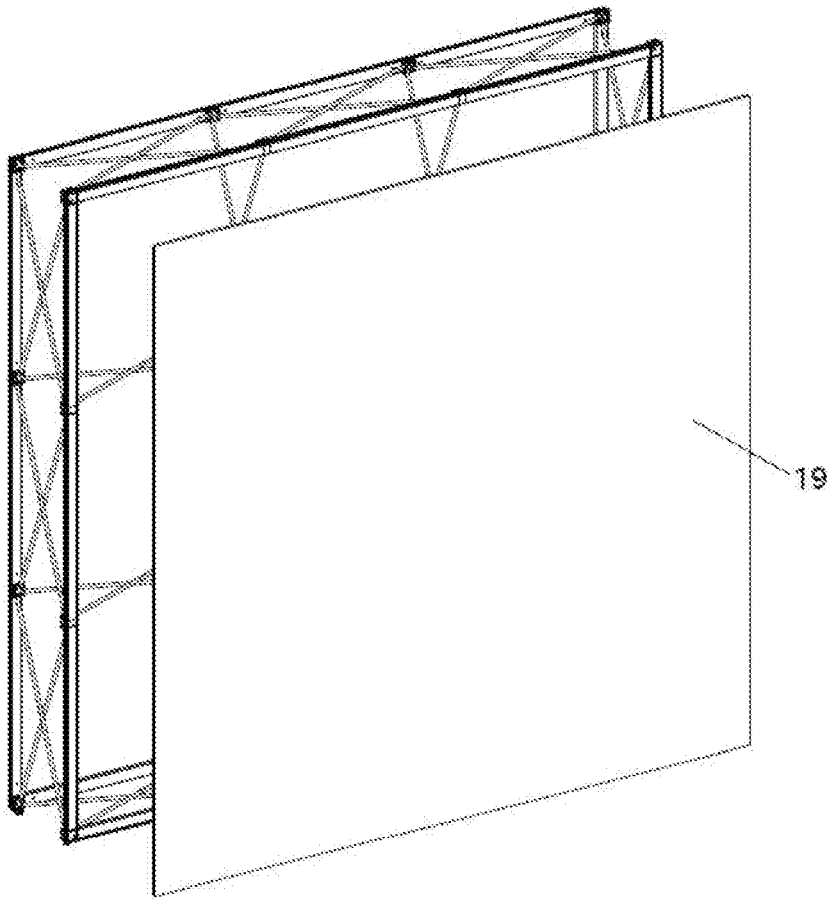
FIG. 19 is a structural schematic view of a single tension fabric popup display with a separate blank display.
Figure 20:
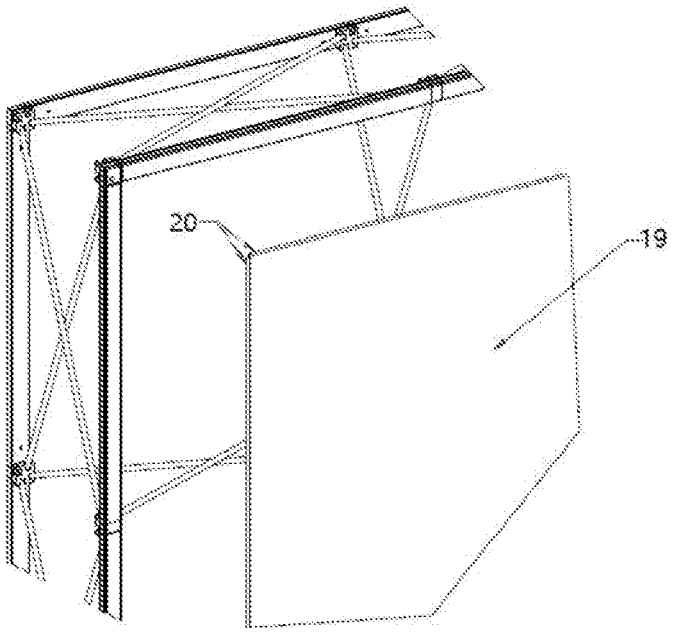
FIG. 20 is a structural schematic view of a single tension fabric popup display with a separate blank display in an enlarged view.

As shown in FIGS. 6-9, a popup display with a preset size and shape is provided by horizontally or/and vertically combining a plurality of tension fabric popup displays as needed. Aluminum grooved straight rods 12 for the adjacent tension fabric popup displays are locked by a plurality of fasteners 16. Referring to FIG. 18 to FIG. 20. The display 19 before or after the combination is formed by inserting the silicone strips 20 at the edges of the display 19 into the grooves 17 of grooved straight rods 12. To be more secure, referring to FIG. 16 and FIG. 17, a plurality of supports 18 may be provided at the bottom of a tension fabric popup display, located in the lower part of a combination of tension fabric popup displays, to further support the popup display in combination.

As shown in FIGS. 10-15, fastener 15 has a horizontal fastener and a vertical fastener, respectively including base plate 1, mobile plate 2, cover plate 3 and rotation shaft 4. First clamp plate 5 with a bend is located at an end of the base plate 1. Rotation shaft 4 penetrates through base plate 1, and a rotation shifting block 6 is disposed on rotation shaft 4 below base plate 1. Eccentric cylinder 7 is positioned at a top end of rotation shaft 4 above base plate 1. Semicircular groove 9 is located in base plate 1 centered at rotation shaft 4. Limiting pole 10 is positioned within semicircular groove 9 by rotation shifting block 6, ensuring rotation shifting block 6 rotates within a semicircle. Second clamp plate 8 with a bend is positioned at an end of mobile plate 2, and a circular aperture engaged with eccentric cylinder 7 is disposed in mobile plate 2. Mobile plate 2 is set around eccentric cylinder 7 via the circular aperture. First clamp plate 5 and second clamp plate 8 have a same orientation; however, the bend of first clamp plate 5 is opposite to the bend of second clamp plate 8. Cover plate 3 is provided above mobile plate 2 and cover plate 3 is fixed to base plate 1 by bolts, to prevent mobile plate 2 from being removed from eccentric cylinder 7. First clamp plate 5 and second clamp plate 8 are locked and released by rotating rotation shifting block 6 to drive mobile plate 2 to move. For the horizontal fastener, the bend of first clamp plate 5 and the bend of second clamp plate 8 are at the same level, while for the vertical fastener, the bend of first clamp plate 5 is higher than the bend of second clamp plate 8. In this invention, the whole fastener 16 may be made of metal, or first clamp plate 5, mobile plate 2 and second clamp plate 8 may be made of metal while the other parts may be made of plastic (bolts are made of metal). When the whole fastener 16 is made of metal, base plate 1 and first clamp plate 5 are integrated while mobile plate 2 and second clamp plate 8 are integrated. When first clamp plate 5 mobile plate 2 and second clamp plate 8 are made of metal while the other parts are made of plastic, first clamp plate 5 is fixed to base plate 1 by bolts, and mobile plate 2 and second clamp plate 8 are integrated, rendering a light weight and low cost to achieve the objectives of this invention.

For assembly of the invention, first, quickly open exhibit grid frame 11, quickly install aluminum grooved straight rods 12 for the eight sides on the two planes of exhibit grid flame 11, combine tension fabric popup displays according to a preset size and shape, and then lock the popup displays with fasteners 16. The display before or after the combination is formed by inserting the silicone strips at the edges of the display into the grooves of grooved straight rods 12. The tension fabric popup displays of the invention may be combined and seamlessly attached in any shape by fasteners 16. There are no folds at the edges of display due to grooved straight rods 12 creating the frameless effect, and thus sufficiently ensuring the integrity of the display from combination of tension fabric popup displays.

The invention claimed is:

1. A popup display, comprising:

at least one freely combinable tension fabric popup display, wherein the tension fabric popup display comprises, an exhibit grid frame;

a plurality of aluminum grooved straight rods, wherein the plurality of aluminum grooved straight rods are connected to eight sides on two planes of the exhibit grid frame; and a display screen on each plane of the exhibit grid frame, wherein the display screen is provided with a silicon strip at each edge;

wherein the popup display with a preset size and shape is provided by combining the at least one tension fabric popup display, the plurality of aluminum grooved straight rods for adjacent tension fabric popup displays are locked by a plurality of fasteners, and the silicon strip at each edge of the display screen is inserted into a groove of each of the plurality of aluminum grooved straight rods of the at least one freely combinable tension fabric popup display or the combination of the at least one freely combinable tension fabric popup displays;

wherein the exhibit grid frame is composed of a plurality of X-shaped pull rods, the plurality of X-shaped pull rods are connected to each other by a plurality of plastic parts with nails; a plurality of link parts are located inside the exhibit grid frame, each link part is fixed between two of the plurality of plastic parts with nails when the exhibit grid frame is open; a plurality of corner grooved plastic parts are respectively fixed to one of the plurality of plastic parts with nails at each corner of the exhibit grid frame, the eight sides on the two planes of the exhibit grid frame are connected to the plurality of aluminum grooved straight rods by the plurality of corner grooved plastic parts at both ends of the plurality of aluminum grooved straight rods.

2. The popup display of claim 1, wherein the plurality of tension fabric popup displays are horizontally or vertically combined to form the popup display with a preset size and shape.

3. The popup display of claim 1, wherein the plurality of tension fabric popup displays are horizontally or vertically combined to form the popup display with a preset size and shape.

4. The popup display of claim 1, wherein the plurality of fasteners have at least one horizontal fastener and at least one vertical fastener, each fastener includes a base plate, a mobile plate, a cover plate and a rotation shaft; a first clamp plate with a first bend is located at an end of the base plate; the rotation shaft penetrates through the base plate, and a rotation shifting block is provided on the rotation shaft below the base plate; an eccentric cylinder is provided at a top end of the rotation shaft above the base plate; a second clamp plate with a second bend is provided at an end of the mobile plate, a circular aperture engaged with the eccentric cylinder is provided in the mobile plate, and the mobile plate is set around the eccentric cylinder via the circular aperture; the first clamp plate and the second clamp plate have a same orientation while the first bend of the first clamp plate is opposite to the second bend of the second clamp plate; the cover plate is provided above the mobile plate to prevent the mobile plate from being removed from the eccentric cylinder; the first clamp plate and the second clamp plate are locked and released by rotating the rotation shifting block to drive the mobile plate to move; for the horizontal fastener, the first bend of the first clamp plate and the second bend of the second clamp plate are at the same level, while for the vertical fastener, the first bend of the first clamp plate is higher than the second bend of the second clamp plate.

5. The popup display of claim 4, wherein a semicircular groove is provided in the base plate centered at the rotation shaft, and a limiting pole is provided within the semicircular groove by the rotation shifting block, ensuring the rotation shifting block rotating within a semicircle.

6. The popup display of claim 4, wherein the cover plate is fixed to the base plate by at least one bolt, to prevent the mobile plate from being removed from the eccentric cylinder.

7. The popup display of claim 4, wherein for the plurality of fasteners, a whole fastener is made of metal, the base plate and the first clamp plate are integrated while the mobile plate and the second clamp plate are integrated.

8. The popup display of claim 4, wherein in the each fastener, the first clamp plate, the mobile plate and the second clamp plate are made of metal while other parts are made of plastic; the first clamp plate is fixed to the base plate by at least one bolt, and the mobile plate and the second clamp plate are integrated.

9. The popup display of claim 1, wherein the plurality of fasteners have at least one horizontal fastener and at least one vertical fastener, each fastener includes a base plate, a mobile plate, a cover plate and a rotation shaft; a first clamp plate with a first bend is located at an end of the base plate; the rotation shaft penetrates through the base plate, and a rotation shifting block is provided on the rotation shaft below the base plate; an eccentric cylinder is provided at a top end of the rotation shaft above the base plate; a second clamp plate with a second bend is provided at an end of the mobile plate, a circular aperture engaged with the eccentric cylinder is provided in the mobile plate, and the mobile plate is set around the eccentric cylinder via the circular aperture; the first clamp plate and the second clamp plate have a same orientation while the first bend of the first clamp plate is opposite to the second bend of the second clamp plate; the cover plate is provided above the mobile plate to prevent the mobile plate from being removed from the eccentric cylinder; the first clamp plate and the second clamp plate are locked and released by rotating the rotation shifting block to drive the mobile plate to move; for the horizontal fastener, the first bend of the first clamp plate and the second bend of the second clamp plate are at the same level, while for the vertical fastener, the first bend of the first clamp plate is higher than the second bend of the second clamp plate.

10. The popup display of claim 9, wherein a semicircular groove is provided in the base plate centered at the rotation shaft, and a limiting pole is provided within the semicircular groove by the rotation shifting block, ensuring the rotation shifting block rotating within a semicircle.

11. The popup display of claim 9, wherein the cover plate is fixed to the base plate by at least one bolt, to prevent the mobile plate from being removed from the eccentric cylinder.

12. The popup display of claim 9, wherein for the plurality of fasteners, a whole fastener is made of metal, the base plate and the first clamp plate are integrated while the mobile plate and the second clamp plate are integrated.

13. The popup display of claim 9, wherein in the each fastener, the first clamp plate, the mobile plate and the second clamp plate are made of metal while other parts are made of plastic; the first clamp plate is fixed to the base plate by at least one bolt, and the mobile plate and the second clamp plate are integrated.

14. The popup display of claim 1, wherein a plurality of supports are provided at bottom of a tension fabric popup display, located in a lower part of a combination of tension fabric popup displays.

15. The popup display of claim 1, wherein a plurality of supports are provided at bottom of a tension fabric popup display, located in a lower part of a combination of tension fabric popup displays.

* * * * *